United States Patent [19]

Jacson et al.

[11] 4,156,360

[45] May 29, 1979

[54] METHOD AND APPARATUS FOR UNSTRESSING PIPE AND THE RESULTING PIPE

[75] Inventors: Michel Jacson; Pierre Huot, both of Montbard, France

[73] Assignee: Vallourec (Usines a Tubes de Lorraine-escaut et Vallourec Reunies), Paris, France

[21] Appl. No.: 850,426

[22] Filed: Nov. 10, 1977

[30] Foreign Application Priority Data

Nov. 12, 1976 [FR] France ..... 76 34179

[51] Int. Cl.[2] ..... B21D 3/12

[52] U.S. Cl. ..... 72/378

[58] Field of Search ..... 72/302, 378; 138/177, 138/178, DIG. 5

[56] References Cited

U.S. PATENT DOCUMENTS

| | | | |
|---|---|---|---|
| 2,336,524 | 12/1943 | Bannister | 72/302 |
| 3,031,750 | 5/1962 | Von Planck | 72/378 |
| 3,469,425 | 9/1969 | Spurr et al. | 72/378 |
| 3,678,727 | 7/1972 | Jackson | 72/378 |

*Primary Examiner*—Lowell A. Larson

*Attorney, Agent, or Firm*—Brisebois & Kruger

[57] ABSTRACT

Circumferential stresses in tubes are relieved by exerting an axial pull on a tube sufficient to elongate the tube at least 0.2%, and maintaining the pull on the tube for a predetermined period of time. The extent of elongation can be as much as 1% and the axial pull can be maintained for several minutes. The technique is particularly useful for substantially reducing or eliminating circumferential stresses in thin wall tubes which are created by straightening the tube with hyperbolic profile rollers.

8 Claims, No Drawings

METHOD AND APPARATUS FOR UNSTRESSING PIPE AND THE RESULTING PIPE

The present invention deals with a method for producing tensile stress-relieved tubes, that is to say in the sense of the present invention, metal tubes not having residual circumferential tensile stress or having only a small amount of such stress. The invention is applicable more particularly to tubes of steel, or of alloys having characteristics analogous to steel, but can also be used for tubes made from other metals.

The invention also deals with a device for putting into operation this process, as well as the tensile stress relieved tubes obtained.

Advantageously the invention can be applied to very long tubes with thin walls. The tubes obtained can be destined for any use whatever but the invention is particularly satisfactory in the case of the manufacture of tubes destined to be used under conditions where resistance to corrosion is important as for example in the field of heat exchangers, or tubes destined for the chemistry or petroleum industries.

It is well known in the metal tube industry and especially the steel tube industry, that the tubes coming from manufacture, whatever be the process and the treatments to which they have been submitted, have a course more or less different from a straight line and in fact are practically never straight. From the usage requirements, which demand straight tubes, the metal tubes are, in great majority, submitted to straightening operations by passage through straightening machines, different types of which exist but the most widely used of which comprise rollers with a hyperbolic profile.

This straightening operation induces in the tubes, originating from their exterior surfaces, residual circumferential tensile stresses whose average value is relatively high, as well as residual compressive stress at the inner surface of the tube.

By circumferential tensile stress is meant tensile stress directed in the transverse plane of cross-section of the tube and in a direction tangent to the circle passing through the point of the tube under consideration.

But, the existence of this tensile stress favors the occurrence of stress corrosion which can hardly be avoided under certain conditions of use and mounting of the tubes. Of course these risks of corrosion reduce the domain of possible use of the tubes and cause serious economic disadvantages.

In addition, in certain instances, such circumferential tensile stresses can arise from treatments other than the already mentioned straightening, and the disadvantages which result from them are the same.

The invention proposes to remedy these different disadvantages and to provide a process permitting producing tubes in which the circumferential tensile stresses are annulled or notably diminished, as well as the corresponding risks of corrosion. In addition, the invention proposes to provide a process that would be particularly economical and simple to put into operation.

The invention has as an object a process for the manufacture of stress relieved tubes characterized by the fact that one submits the tube to be stress relieved, to at least one axial pulling force greater than or equal to the value corresponding to an elongation of 0.2% for a sufficient length of time to cause the desired decrease or the elimination of these stresses.

This pull can be defined as corresponding to the conventional value called "conventional elastic limit of elongation of 0.2%."

One has certainly already proposed previously to exert an axial pull on tubes, but under different conditions from those of the invention and for different reasons, for example, in the case of rigid thick tubes to render these tubes straight by a squaring action. In contrast, the invention allows obtaining entirely different results.

In a preferred manner of operation one exerts on the tube a pull causing elongation of the tube, up to as much as 1%, this extent of elongation being that undergone by the tube when it is under the pulling force.

Of course conforming to the invention the tube is not then submitted to any treatment, straightening or otherwise, capable of causing the appearance of new circumferential tensile stresses.

More particularly, the invention has as an object a process in which one causes straightening of the tube by passage through straightening machines with hyperbolic rollers, following which one effects the above mentioned axial pull on the tube.

The length of time during which the tube must be kept under traction depends on the nature of the tube.

In general, one can apply immediately a sufficient force on the tube and keep the tube under tension for a length of time of up to several minutes, for example 2 to 3 minutes.

As a variation, one can exert a slow pull and progressively attain the values provided by the invention and this being able to be over a length of time up to several minutes, for example 2 to 4 minutes.

In general, the process according to the invention is applicable both to welded tubes as well as to tubes made by seamless processes.

In general, it is preferable to exert a pull leading to a lesser elongation for cold rolled tubes than for drawn tubes.

The invention has likewise as its object a device for the operation of this process, this device characterized by the fact it comprises means for placing the tube under a tension force to attain and preferably to exceed the value corresponding to an elongation of 0.2% and preferably to obtain a deformation as much as 1% during the above mentioned time interval.

In one preferred embodiment the device comprises a pulling bench with a first fixed jaw gripping one extremity of the tube. A second jaw mounted on a slide for gripping the other extremity and exerting a pulling force, preferably by a slow displacement of sufficient amplitude for a duration of several minutes or longer.

The invention has likewise as its object the tensile stress relieved tubes of the process according to the invention.

Other advantages and characteristics of the invention will become apparent to the reader of the following description given as a non-limiting example.

One manufactures rust resistant seamless steel tubes having a diameter of 22.22 mm, a wall thickness of 1.27 mm and a length of up to 30 meters.

These tubes, coming from straightening, have tensile circumferential stresses which are on the order of 20 to 25 HB and which can be determined by the split-ring lengthwise method.

The two extremities of the tube are taken under load by the jaws of a pulling bench and the slide is put in motion. Displacement of the moving jaw is effected for four minutes and attains a value of 240 mm at the end of this duration, which corresponds to 0.8% of the length of the tube and a force by the pulling bench of about 3.5 tons. After release from the frame the tube retains a residual elongation of 0.65%.

Tests for corrosion with magnesium chloride, as well as split-ring measurements, show that the residual circumferential tensile stresses have disappeared.

The process of the invention has been described for the manufacture of tubes having undergone straightening. It is however likewise possible, as a variation, to employ the process according to the invention for tubes having tensile circumferential stresses coming from sources other than straightening, with the condition understood of not making the tubes undergo a new working after the operation of the process according to the invention.

We claim:

1. A process of relieving circumferential stresses in tubes comprising, exerting on the tube to be stress relieved an axial pull sufficient to cause an elongation of the tube of at least 0.2% but without substantially modifying the dimensions of the tube, and maintaining said axial pull for a predetermined period of time to substantially decrease the circumferential stresses in the tube.

2. A process according to claim 1, further comprising, straightening the tube prior to exerting said axial pull on the tube.

3. A process according to claim 1, wherein said step of exerting an axial pull comprises, exerting an axial pull sufficient to cause an elongation of the tube of at least 1%.

4. A process according to claim 1 wherein said period of time during which said axial pull is maintained is at least several minutes.

5. A process according to claim 1 wherein said step of exerting an axial pull comprises exerting a slow progressive pulling force to attain said elongation of at least 0.2% over a time interval of several minutes.

6. Circumferential tensile stress relieved tubes obtained by the process of claim 1.

7. A process according to claim 1 wherein said step of exerting an axial pull comprises, exerting an axial pull sufficient to cause an elongation of the tube between 0.2% and 1.0%.

8. A process of relieving circumferential stresses in very long tubes with thin walls comprising straightening the tubes with hyperbolic rollers and then exerting on the tube to be stress relieved an axial pull sufficient to cause an elongation of the tube of at least 0.2% but without substantially modifying the dimensions of the tube and maintaining said axial pull for at least two minutes.

* * * * *